US005125633A

United States Patent [19]

Fecker et al.

[11] Patent Number: 5,125,633

[45] Date of Patent: Jun. 30, 1992

[54] SETUP FOLDING MACHINE WITH ENCLOSURE FEED MECHANISM

[75] Inventors: Rainer Fecker, Furtwangen; Werner Lehmann, Gutach, both of Fed. Rep. of Germany

[73] Assignee: Mathias Bäverle GmbH, Fed. Rep. of Germany

[21] Appl. No.: 689,307

[22] Filed: Apr. 22, 1991

[30] Foreign Application Priority Data

Apr. 23, 1990 [DE] Fed. Rep. of Germany ..... 4012859

[51] Int. Cl.[5] ..... B42C 1/00

[52] U.S. Cl. ..... 270/51; 270/45; 493/421

[58] Field of Search ..... 270/32, 37, 45, 47, 270/51; 493/419, 420, 421

[56] References Cited

U.S. PATENT DOCUMENTS

| | | | |
|---|---|---|---|
| 3,242,637 | 3/1966 | Wills | 493/420 |
| 3,265,382 | 8/1966 | Sherman | 270/45 |
| 3,336,726 | 8/1967 | Mayer | 270/45 |
| 3,416,785 | 12/1968 | Sherman | 270/45 |
| 3,804,399 | 4/1974 | Rupp | 493/421 |
| 4,270,742 | 6/1981 | Kobayashi | 270/37 |
| 4,746,108 | 5/1988 | Hirayama | 270/45 |
| 4,900,391 | 2/1990 | Mandel | 270/45 |
| 5,044,617 | 9/1991 | Roberts | 270/45 |

FOREIGN PATENT DOCUMENTS

| | | | |
|---|---|---|---|
| 3830656 | 11/1989 | Fed. Rep. of Germany | 270/47 |
| 57590 | 3/1966 | German Democratic Rep. | 270/45 |

*Primary Examiner*—Edward K. Look
*Assistant Examiner*—Therese M. Newholm
*Attorney, Agent, or Firm*—McGlew & Tuttle

[57] ABSTRACT

An setup folding machine with at least two folding stations (F1, F2), which are formed by a pair of folding rollers (W1/W2; W2/W3) each. An intake device is provided including two feed rollers (T1, T2), which determines the speed of feed of the material to be folded, the intake device is located in a feed web (4) moving past the first folding station (F1). A enclosure feed mechanism is positioned directed toward the first folding station (F1), arranged behind the intake device. In order for an enclosure to be able to be optionally inserted into the first or second fold, the first folding station (F1) is associated with a knife-like deflecting member (6), which can be moved to the first folding station (F1) while the material is being deflected at the same time to form a fold, and can be actuated individually for each folding process by an electronic control device (21). An electromagnetcontrollable sheet deflector acting as a second deflecting member (26) is arranged directly in front of the folding pocket (25) located between the first folding station and the second folding station (F2), and the second deflecting member (26) can be moved from its resting position to the second folding station (F2) after the material to be folded has entered the folding pocket (25), while the material to be folded (43, 55) is deflected at the same time to form a fold.

7 Claims, 8 Drawing Sheets

FIG. 3
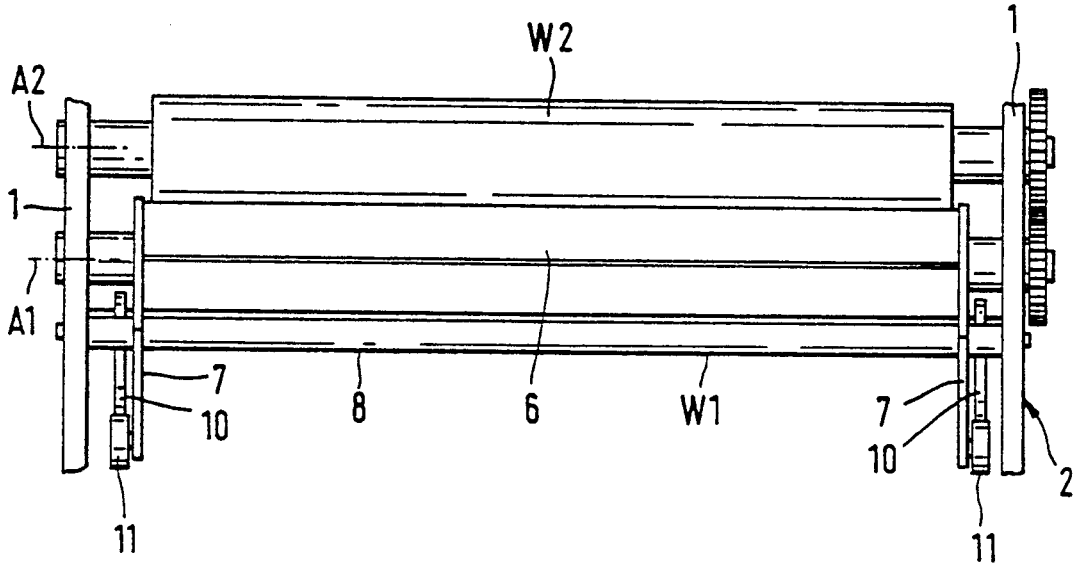
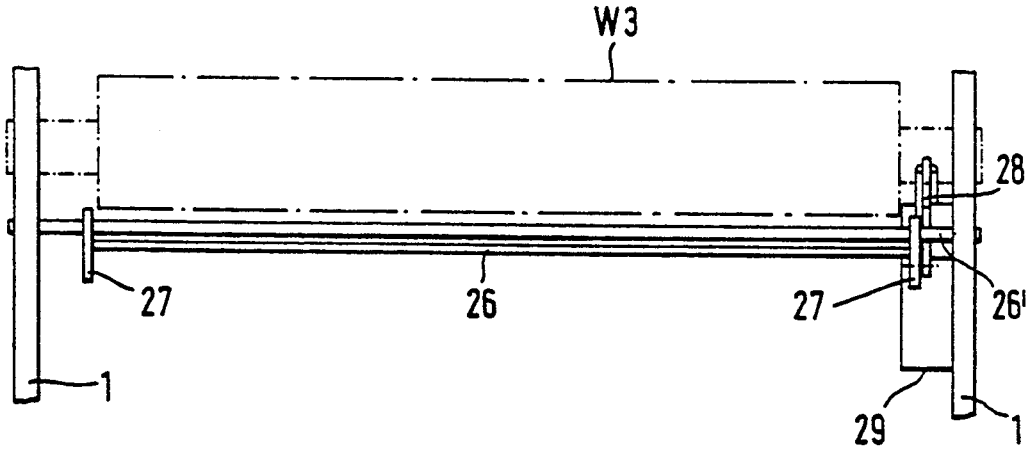
FIG. 4

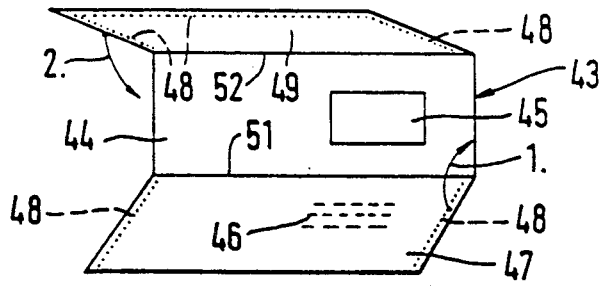
FIG.10
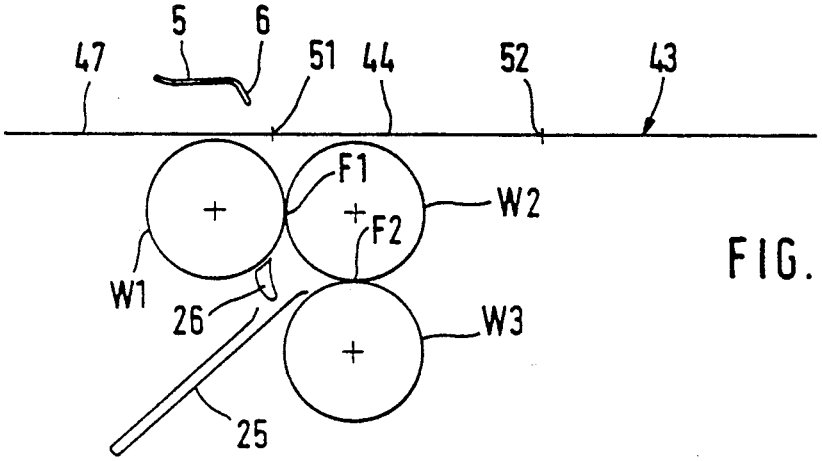
FIG.10a
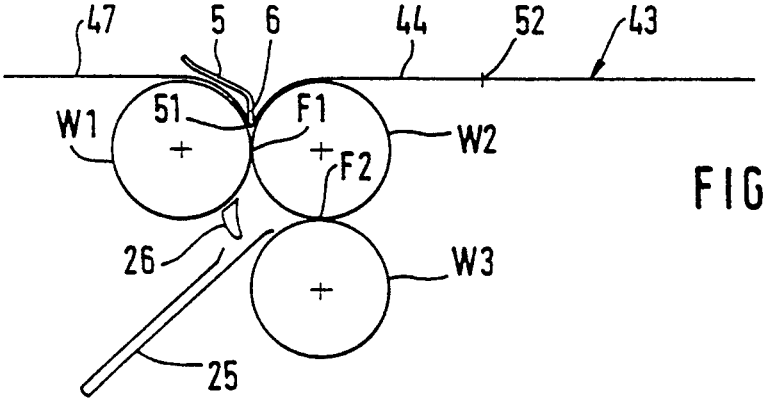
FIG.10b
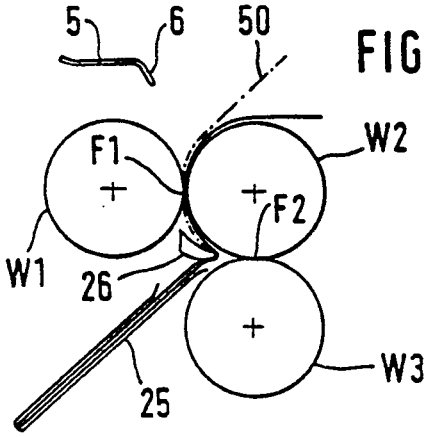
FIG.10c
FIG.10d
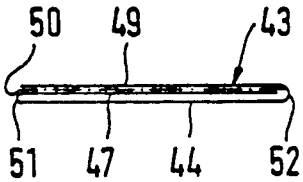

FIG. 11
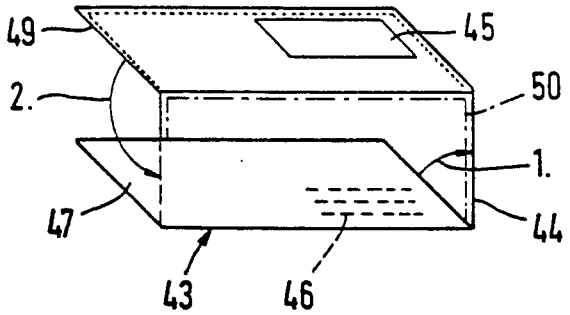
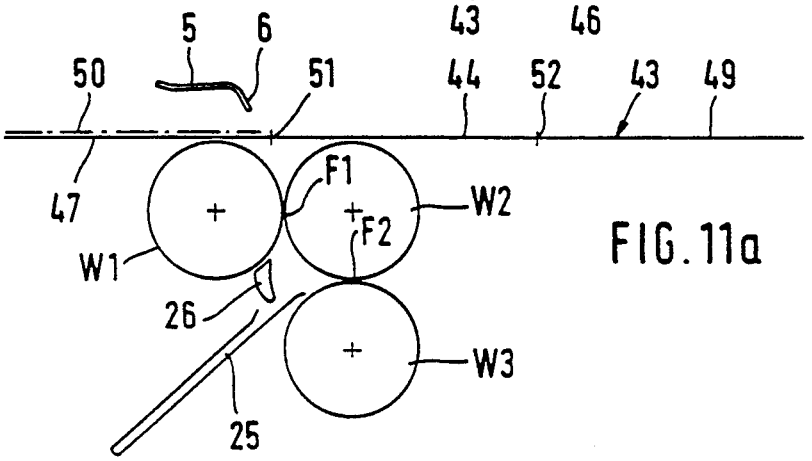
FIG. 11a
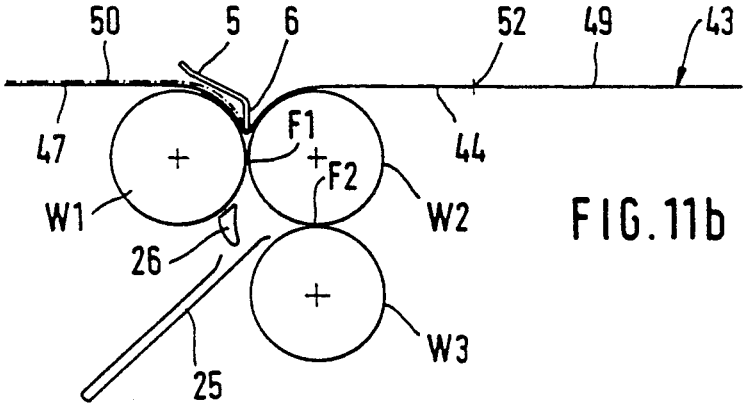
FIG. 11b
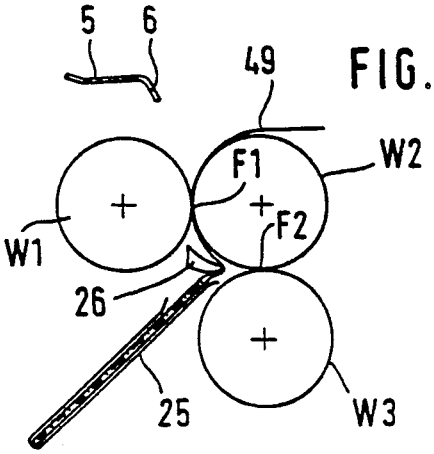
FIG. 11c
FIG. 11d
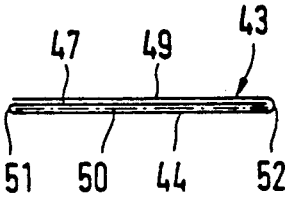

SETUP FOLDING MACHINE WITH ENCLOSURE FEED MECHANISM

FIELD OF THE INVENTION

The present invention pertains to an setup folding machine with at least two folding stations each formed by one pair of folding rollers an intake device for the material to be folded, which consists of two feed rollers determining the feed speed, located in a feed web that passes by the first folding station and provided with a feed limiting device. An enclosure feed mechanism directed toward the first folding station is arranged behind the intake device, and a folding pocket with a paper stop is arranged behind the first folding station.

BACKGROUND OF THE INVENTION

The prior-art setup folding machines with enclosure feed mechanisms are each equipped with two folding pockets and are adjusted such that they produce an inwardly curled fold. The paper deflectors otherwise common in setup folding machines, with which the intake openings of the two folding pockets can be closed and the material being folded is guided past one folding pocket and to the next folding station, are not present in such setup folding machines equipped with enclosure feed mechanisms. They are not needed, because only the inwardly curled fold type with two folds is used.

On the other hand, it is only possible to add enclosures to the first fold of the material being folded, because direct deflection of the material being folded from the first folding station into the second folding station is not possible because of the absence of a paper deflector. Moreover, such setup folding machines can be provided with only one enclosure feed mechanism, which is directed directly toward the first folding station, which means that only one enclosure can be added to one sheet of material to be folded.

A pocketless paper folding machine is known from Germany patent DE 38,30,656 C1. It discloses a contactless feed limiting device is located in a feed web of the material to be folded which passes by a folding station. The feed limiting device determines the actual folding length, and can be actuated individually for each folding process by means of a microprocessor and an electronic control device. The respective material being folded is deflected toward the folding stations by knife-like or bar-like deflecting members at a speed corresponding to the feed movement of the material being folded. However, this prior-art paper folding machine is not provided with an enclosure feed mechanism.

In addition, a folding machine equipped with two folding stations and two folding pockets is known from German publication DE 38,40,856 A1. It discloses a sheet guiding member driven by a linear motor and controlled by an electronic control device arranged between the first and second folding stations. This folding machine also has no enclosure feed mechanism, so that the sheet guiding member is used only to determine the type of folding.

SUMMARY AND OBJECTS OF THE INVENTION

It is an object of the present invention to design a setup folding machine with an enclosure feed mechanism of the type described in the introduction such that different enclosures can be optionally inserted, individually or together, and into the first and/or second fold of the material being folded according to a program that can be input.

According to the invention, a folding machine is provided including at least two folding stations wherein each folding station is formed by a pair of folding rollers. An intake device for the material to be folded is provided which includes two feed rollers which determine the speed of feed and are located to engage a feed web which is moved past the first folding station and is provided with a feed limiting device. An enclosure feed mechanism is provided directed toward the first folding station arranged behind the intake device. A folding pocket is provided with a paper stop arranged behind the first folding station. A second enclosure feed mechanism is provided arranged in front of the intake device. The enclosures of the second enclosure feed mechanism are fed to the first folding station by a knife-deflecting member of a stopless feed limiting device. The deflecting member can be moved to the first folding station at a speed corresponding to the feed of the material to be folded, while the material to be folded is deflected at the same time to form a fold. The deflecting member can be actuated individually for each folding process by an electronic control device depending on a feed measuring device. In order to feed the enclosures directly to the second folding station, an electromagnetic controllable deflector is provided for deflecting the folded material. The electromagnetic controllable deflector is arranged as a second deflecting member, directly in front of the folding pocket. The second deflecting member can be moved, after the material being folded has entered the folding pocket, from a resting position, which does not affect the material being folded and the enclosures, to a second folding station while the material being folded is deflected at the same time to form a fold.

A folding machine thus equipped accomplishes the task set with simple means. Its use is considerably more versatile than that of the prior-art setup folding machines of this class. In addition, high reliability of operation and high pace of work are guaranteed. The use of the knife-like deflecting member instead of the otherwise common folding pocket in front of the first folding station makes it possible to arrange the second enclosure feed mechanism in front of the intake device.

The enclosures to be optionally added from the second enclosure feed mechanism can be added during the folding process in addition to the enclosures from the first enclosure feed mechanism, which is directed, e.g., toward the first folding station, or instead of the enclosures from the first enclosure feed mechanism.

By designing the present invention such that the deflecting member is formed of a bent guide plate and has a rear guide web directed toward the intake device, which rear guide web extends at an angle through the feed web in a deflected position of the deflecting member, it is ensured in a simple manner that the enclosures fed in from the second enclosure feed mechanism arranged in front of the intake device are fed by the intake device directly to the first folding station, and it is advantageous to keep the deflecting member in the deflected position until the last third of the material being folded has reached the first folding station in order for even an enclosure fed from the second enclosure feed mechanism to the second fold to be reliably grasped by the two folding rollers forming the first folding station.

The embodiment of the invention in which the enclosure feed mechanisms each include one feeding attachment with a decollating device and a waiting station with a feed roller pair that can be activated by the electronic control device, makes a substantial contribution to reliable operation in terms of the decollation of enclosures and also to increasing the pace of work.

The embodiment of the invention including the electronic control device formed as a microprocessor and a feed measuring device including a pulse generator synchronized with the feed motion of the material to be folded, and a presettable coincidence circuit, makes it possible to program the setup folding machine in a simple manner in terms of both the format of the material being folded and the addition of enclosures.

The embodiments including the feed roller pair which can be coupled with the drive synchronized with the feed motion of the material being folded by a clutch that can be actuated with an electromagnet and the feed roller pair provided with a feed speed that is greater than the speed in which the material being folded is fed, contribute to increasing the reliability of operation and the pace of work.

An embodiment of the present invention will be explained in greater detail below on the basis of the drawing.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a partial view taken in the direction of arrow III from FIG. 1;

FIG. 4 is a top view of a second deflecting member arranged behind the first folding station;

FIG. 10 is schematically a partially unfolded folded sheet;

FIGS. 10*a*, 10*b*, and 10*c* are schematically different phases of the operation of the folding machine;

FIG. 10*d* is a folded sheet with an enclosure inserted;

FIG. 11 is a partially unfolded folded sheet with an enclosure added;

FIGS. 11*a*, 11*b*, and 11*c* are schematic representations of different phases of the operation of the folding machine;

FIG. 11*d* is a folded sheet with enclosure;

DETAILED DESCRIPTION OF THE PREFERRED EMBODIMENT

Figure 1:
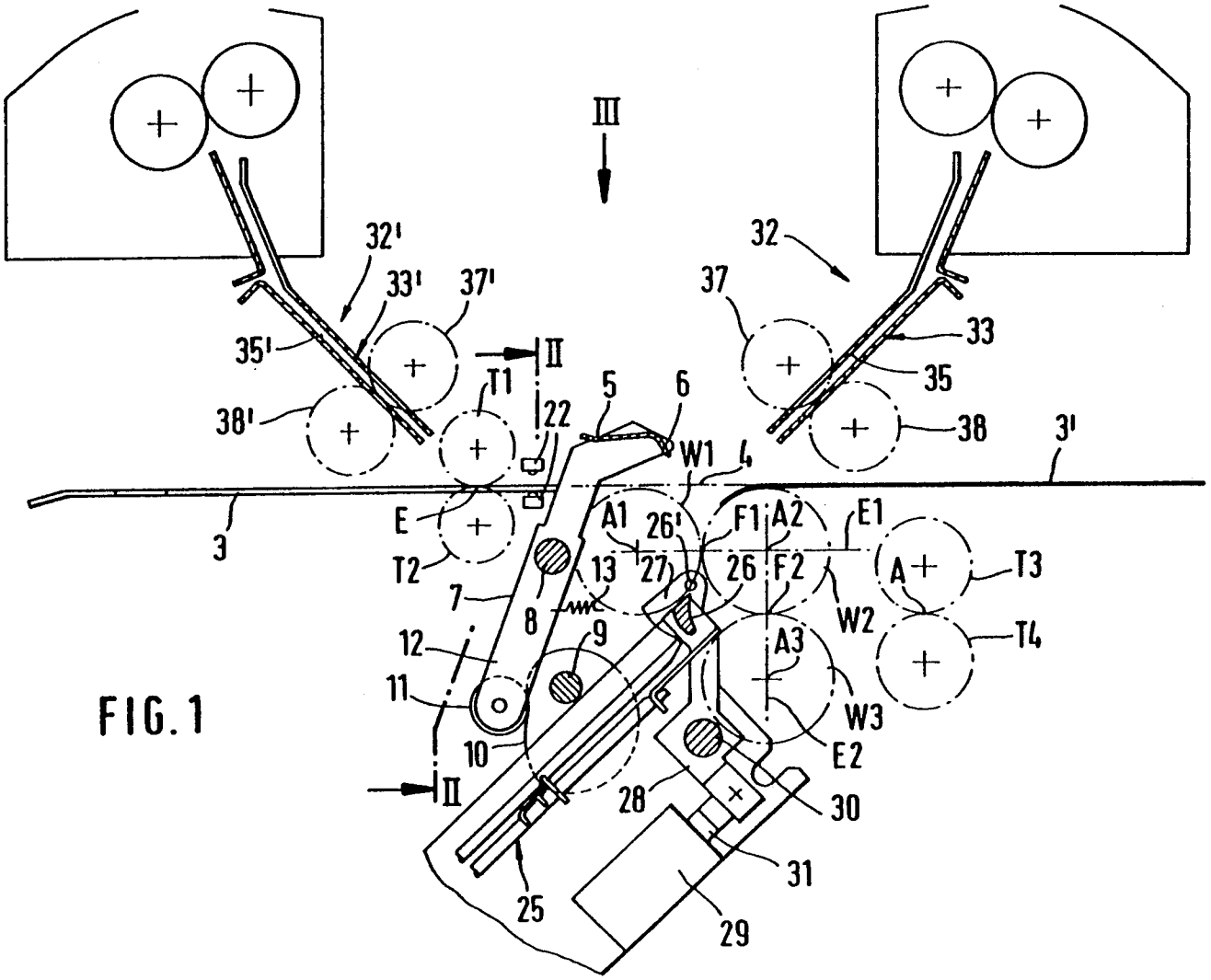
FIG. 1 is a simplified schematic representation of a side view of a folding machine with two enclosure feed mechanisms.
Figure 2:
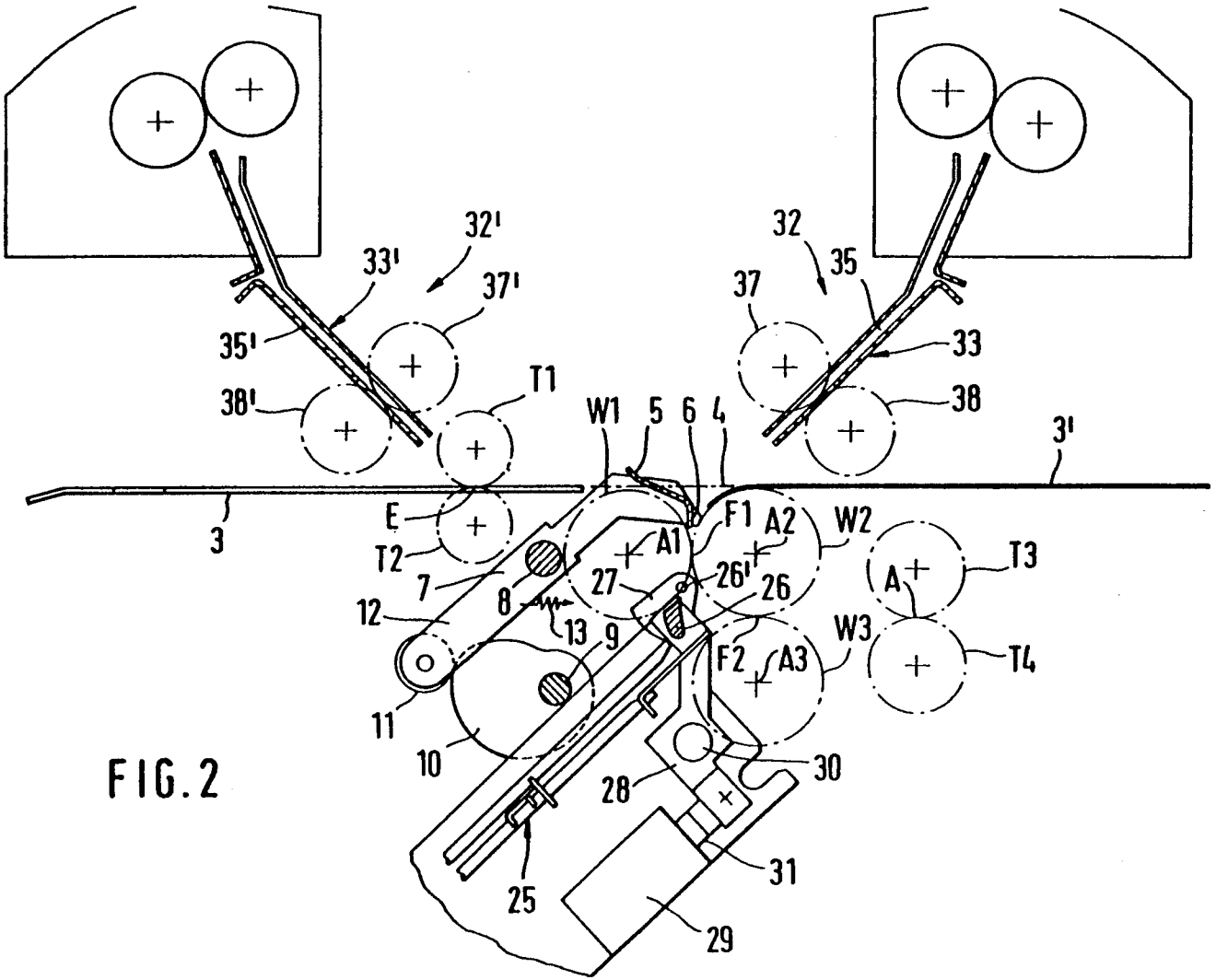
FIG. 2 is the same representation as FIG. 1, but in another functioning position of the deflecting member.

In the folding machine shown schematically in FIGS. 1 through 9, three folding rollers W1, W2, and W3 in a frame 2 consisting of two flat bars 1 are arranged relative to one another such that their axes Al, A2, and A3 are located in the corners of an isosceles right triangle. The rollers form, in pairs, a horizontal plane E1 and a vertical plane E2, and these pairs, also form a first folding station F1 and a second folding station F2, in which the jacket surfaces of the folding rollers W1 and W2 as well as W2 and W3 touch one another. To feed in the material to be folded, two feed rollers T1 and T2 form an intake E, which is located at the level of a horizontal paper guide 3. Two more transport rollers or cylinders T3 and T4, which together form a delivery station A, through which the folded material leaves the folding machine, are arranged behind the second folding station F2 in the direction of movement.

The paper guide 3 with the intake E is arranged such that the material to be folded is fed in and reaches a second paper guide 3'. The material is fed approximately tangentially over the first folding roller W1 past the first folding station F1. The second paper guide 3' is located in the same horizontal plane as the intake E, so that it forms, together with intake E, a feed web 4 moving past the first folding station F1, which is indicated by a dash-dotted line.

On the side of the feed web 4 located opposite the folding station F1, a knife-like deflecting member 6 is arranged, which extends over the entire length of the folding station 1 and the folding rollers W1 and W2 and is fastened on two two-armed pivoted levers 7. The knife-like deflecting member 6 consists of a bent sheet metal part and has a rear guide web 5, which is directed toward the intake E and extends at an angle through the feed web 4 in the deflected position shown in FIG. 2. The pivoted levers 7 in turn are arranged nonrotatably on a common shaft 8 such that they are located axially outside the two front sides of the folding roller W1 and thus can be pivoted past this roller. The shaft 8 is mounted rotatably in the frame 2 eccentrically to the axis A1 of the folding roller W1 beneath the feed web 4 and between the folding roller W1 and the intake E. To pivot the pivoted levers 7, two cam disks 10 fastened on a shaft 9 mounted beneath the folding roller W1 are provided, and from time to time, the cam disks 10 can be brought into driving connection with the folding roller W1 via a one-stop clutch 14 (see FIG. 8), which may be designed, e.g., as a wrap sling clutch, and via gears 15 and 16. Feeler rolls 11 of a second lever arm 12 of the pivoted lever 7, on which a tension spring 13 acts in the corresponding direction, are in contact with the jacket surfaces of the cam disks 10. The curved shape of the cam disks is designed such that in the case of synchronism between the cam disks 10 and the folding roller W1, the deflecting member 6 is moving toward the first folding station F1 at the speed with which the material to be folded is being fed, and feeds the material to be folded to this first folding station for folding.

The one-stop clutch 14 is engaged in a particular case by means of a pawl 17, which is actuated by an electromagnet 18 and extends, in its resting position, under a blocking shoulder 19 of a control ring 20 of the one-stop clutch 14 in a locking manner. When the electromagnet 18 is briefly energized, the pawl 17 releases the control ring for one revolution of the shaft 9 with the cam disks 10. The energization of the electromagnet 18 at the correct time is controlled by an electronic control device and by means of a microprocessor 21 depending on a feed measuring device that is not shown here. This feed measuring device includes a photocell 22 in the feed web 4 and a pulse generator 23, both of which are connected to the microprocessor 21, and by which the electromagnet 18 is controlled. The pulse generator 23 is synchronized with the folding rollers W1, W2 and W3, as well as with the feed rollers T1 and T2, and it sends counting pulses, whose number is an indicator of the feed length, to a programmable coincidence circuit of the microprocessor 21.

In addition, the microprocessor 21 or its coincidence circuit can be programmed by means of an entry keypad 24 and can be set such that different fold length and different sheet lengths or different feed lengths can be set. Depending on which has been set the microprocessor 21 causes the electromagnet 18 to operate in case of coincidence.

A second deflecting member 26 in the form of a paper deflector is arranged beneath the first folding station F1 directly in front of the folding pocket 25 associated with the folding station F1. The deflecting member 26 is fastened on two pivoted levers 27 of a shaft 26' mounted in the frame 2 in parallel to the folding rollers W1, W2, and W3, and can be pivoted by an electromagnet 29 via an intermediate lever 28 from the resting position shown in FIGS. 1 and 2 into a pivoted position shown, e.g., in FIGS. 10*c* and 11*c*. In this pivoted position, sheets of folded material and enclosures arriving from the first folding station F1 can be guided directly to the second folding station F2 past the folding pocket 25. The intermediate lever 28 is pivotably mounted on a pivot pin 30, and is hinged to one of the pivoted levers 27 and to the armature 31 of the electromagnet 29.

The electromagnet 29 is also controlled by the microprocessor 21 according to the predetermined program.

Figure 5:
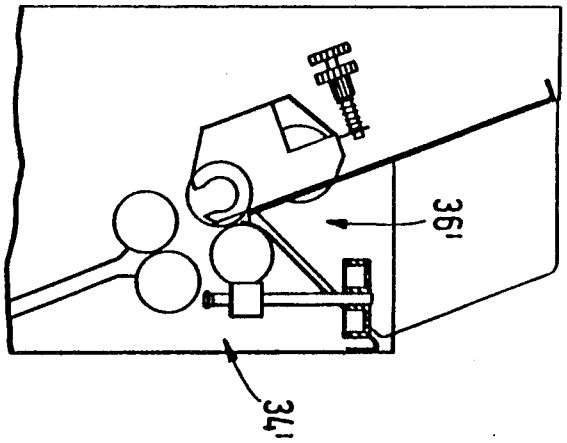
FIGS. 5 and 6 are the decollating devices of the two enclosure feed mechanisms according to FIGS. 1 and 2.
Figure 6:
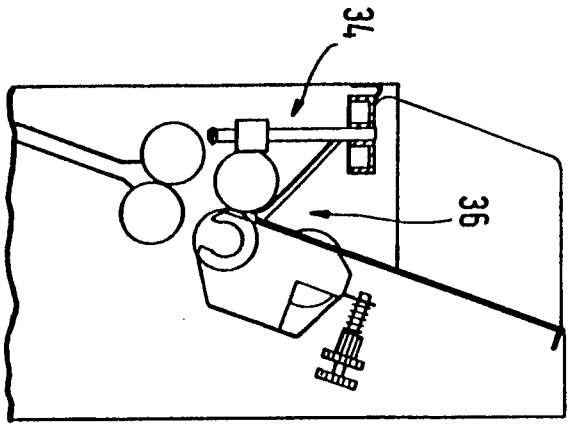
Figure 7:
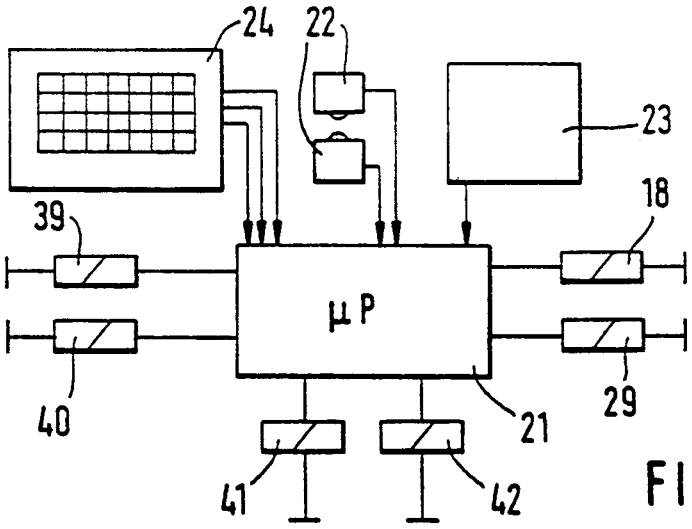
FIG. 7 is a simplified representation of a circuit diagram.
Figure 8:
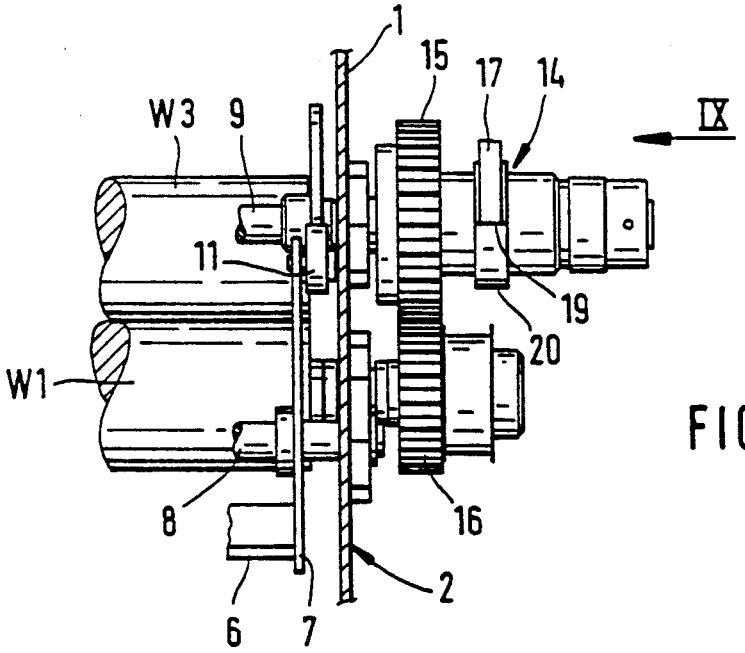
FIG. 8 is a partial sectional view taken along line II—II from FIG. 1.
Figure 9:
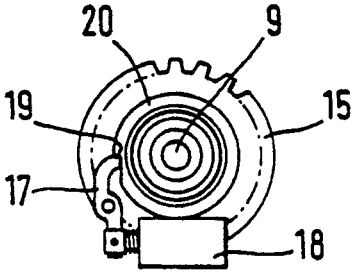
FIG. 9 is a view taken in the direction of arrow IX from FIG. 8.

Two enclosure feed mechanisms 32 and 32' of essentially identical shape are arranged above the feed web 4, and these enclosure feed mechanisms consist of a waiting station 33, 33' and a decollating device 34, 34' shown in FIGS. 5 and 6, and are also controlled by the microprocessor 21. The individual enclosures are fed by a feeding attachment 36 and 36', respectively, into the waiting station 33 and 33', respectively, and from there to the folding machine through the feed rollers 37, 38 and 37', 38', respectively. Both the decollating devices 34 and 34' and the feed rollers 37, 38 and 37', 38', respectively, are driven, like the shaft 9 of the cam disks 10, via clutches which can be actuated by an electromagnet and whose electromagnets 39, 40 and 41, 42, respectively, are driven by the microprocessor 21 according to a proqram.

The feed rollers preferably have a somewhat higher delivery speed than the feed rollers T1, T2 and the folding rollers W1, W2, and W3.

The waiting stations 33 and 33' each have sheet guide shafts 35 and 35', respectively, which are directed at an angle toward the feed web 4. The arrangement has been selected to be such that the sheet guide shaft 35 of the first enclosure feed mechanism 32 is directed behind the feed rollers T1, T2 of the intake device and directly toward the first folding station F1, while the sheet guide shaft 35' of the second enclosure feed mechanism 32' is arranged in front of the feed rollers T1 and T2 and is directed directly toward the intake E.

Figure 12:
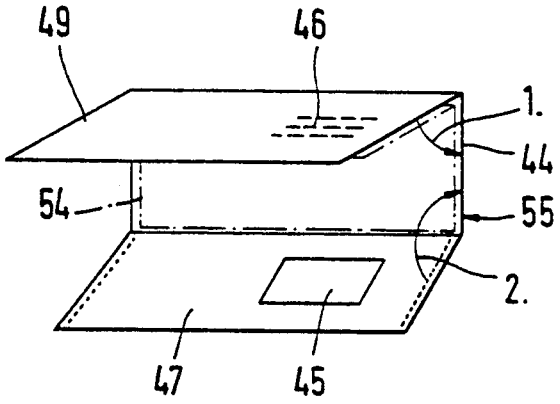
FIG. 12 is another, partially unfolded folded sheet with another enclosure.
Figure 12A:
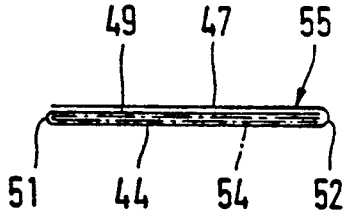
FIG. 12*a* is the folded sheet according to FIG. 12 in the folded state with an enclosure.

As will be explained in greater detail below, using the two enclosure feed mechanisms 32 and 32', the present invention is able to produce the types of folding with enclosures shown schematically in FIGS. 10*d*, 11*d*, and 12*a*.

FIG. 10 shows a folded sheet 43, which was folded twice in the form of an inwardly curled fold and is again partially opened. The middle part 44 of the folded sheet 43 is provided with a window 45. In the folded state, e.g., the address field 46, which is arranged on the inside of the lower sheet section 47, shall be visible through the window 45 from the outside.

While the lower sheet section 47 is provided with adhesive strips 48 only along its side edges, the upper sheet section 49 have adhesive strips 48 along both the side edges and the transverse edge. The inner surface of the entire sheet may be written on.

To fold the folding sheet 43 in the form of an inwardly curled fold shown in FIGS. 10 and 10*d* and to insert at the same time during the folding process an enclosure 50 between the sheet section 47 and the sheet section 49, the following processes take place on the machine:

The paper sheet 43, which has not yet been folded, moves into the position shown in FIG. 10*a* in the feed web 4. The folds 51 and 52 to be produced are indicated by short dashes on the folding sheet 43. When the folding sheet 43 in the feed web 4 has advanced so far that the first fold 51 to be formed is located approximately above the folding station F1, the pivoted lever 7 with the deflecting member 6 is actuated by the cam disks 10, which perform one revolution, such that the position at which the fold 51 is to be formed will exactly reach the folding station F1, as is shown in FIG. 10*b*. The fold 51 formed in the folding station F1 will then enter the folding pocket 25 with the two adjoining sheet sections 44 and 47. At the same time, due to appropriate excitation of the electromagnet 41, an enclosure 50 is fed in from the waiting station 33 of the first enclosure feed mechanism 32 by the feed rollers 37 and 38 at such a point of time that it will arrive in the folding station F1 approximately simultaneously with the fold 52 or slightly later. As soon as the fold 51 has reached the stop of the folding pocket 25, the second deflecting member 26 is promptly pivoted toward the folding station F2, so that the fold 52 is deflected together with the enclosure 50 into the folding station F2, and the folded form with inserted enclosure 50 as shown schematically in FIG. 10*d* is formed.

Since the enclosure 50 was inserted in this case from the sheet guide shaft 35 directed directly toward the folding station F1, the deflecting member 6 was able to return into its starting position shown in FIGS. 10*a* and 10*b* immediately after reaching its lowest deflected position, which is shown in FIG. 10*b*.

However, if the enclosure 50 had had to be fed in from the sheet guide shaft 35' of the second enclosure feed mechanism 32', the deflecting member 6 would have had to remain in the position shown in FIG. 10*b* until the front edge of the enclosure 50 had been grasped by the folding station F1. The guide web 5 is provided on the deflecting member 6 precisely for this case. Its task is namely to deflect the enclosures being fed in from the second enclosure feed mechanism 32' from the feed web 4 to the folding station F1, as is shown in FIG. 11*b*.

In the case of the folded sheet 43 shown in FIG. 11, the window 45 is arranged in the upper sheet section 49, and the address field 46, which is to be readable through the window 45 in the folded state of the sheet, is on the outside of the lower sheet section 47. The enclosure 50, which is indicated by dash-dotted lines in FIG. 11, is to be added to the first fold 51 in this case in order for it to be inserted in the final state between the middle sheet section 44 and the lower sheet section 47, as is shown in FIG. 11*d*.

As is apparent from FIG. 11*a*, the enclosure 50 is fed in in this case from the second enclosure feed mechanism 32' such that its front edge will reach the folding station F1 together with the fold 51, it will be inserted between the two sheet sections 44 and 47 when the first fold 51 is formed, and it will also enter the folding pocket 25 between the two sheet sections 44 and 47. Once this has happened, the deflecting member 26 is again pivoted into its deflected position shown in FIG. 11*c*, so that the sheet 43 being folded is deflected toward the second folding station F2 to form the second fold 52, and the end product shown in FIG. 11*d*, an inwardly curled fold, in which the enclosure 50 is inserted into the first fold 51, is obtained.

While the enclosures 50 have a format that corresponds to about one third of the format of the nonfolded sheet, it is also possible to insert enclosures whose format corresponds to two thirds of the folded sheet. Such an enclosure 54 is shown in FIGS. 12 and 12*a* together with a folded sheet 55. In the case of the folded sheet 55, the window is arranged in the lower sheet section 47, and the address field 46 is on the outside of the upper sheet section 49.

When folding the folding sheet 55, the enclosure 54 is fed in from the second enclosure feed mechanism 32' such that the front edge of the enclosure 54 is located in the vicinity of the fold 52, and it is folded in half when the first fold 51 is being formed in the folding station F1. However, the folding sheet 55 is introduced in this case into the intake E such that the lower sheet section 47, rather than the sheet section 49, as in the preceding examples, will be the leading section. As was described before, the folding sheet 55 is then deflected, together with the enclosure 54, into the first folding station F1 by the deflecting member 6 pivoting downward, so that the sheet sections 44 and 49 will enter the folding pocket 25 in this case, and the folded enclosure 54 will come to lie between the two sheet sections 44 and 49. With an appropriate deflection of the deflecting member 26, this is followed by the second folding in the folding station F2, and the folded product with the enclosure 54 inserted, as is shown schematically in FIG. 12*a*, will appear as the end product.

Appropriate programming of the microprocessor by means of the entry keypad 24 also makes it possible to add one enclosure each from the two enclosure feed mechanism 32 and 32' to the same folded sheet 43 and 55, respectively, such that one enclosure will be located in the first fold 51 and the other enclosure in the second fold 52. This is, of course, meaningful only if different enclosures are contained in the two enclosure feed mechanisms 32 and 32'.

In addition, it is also possible to produce a Z-shaped or zigzag fold instead of an inwardly curled fold with the setup folding machine described here. The microprocessor 21 can also be programmed for this type of folding without problems.

While a specific embodiment of the invention has been shown and described in detail to illustrate the application of the principles of the invention, it will be understood that the invention may be embodied otherwise without departing from such principles.

What is claimed is:

1. A Folding machine, comprising: at least two folding stations, each folding station being defined by cooperating folding rollers; intake means including two feed rollers engaging a web for movement past the first folding station for determining the speed of feed, said intake means including a feed limiting device; a first enclosure feed means for directing a first enclosure toward said first folding station, said first enclosure feed means being arranged behind said intake device, with respect to the direction of feed; a folding pocket with a paper stop, said folding pocket being arranged behind said first folding station, with respect to a direction of feed; a second enclosure feed means for supplying a second enclosure and arranged in front of said intake device; stopless feed limiting means for feeding enclosures of said second enclosure feed means to the first folding station, said limiting means including a knife-like first deflecting member movable to said first folding station at a speed corresponding to a feed of the material to be folded, while the material to be folded is deflected simultaneously to form a fold; an electromagnetic controllable deflector for feeding enclosures directly to the second folding station, said electromagnet controllable deflector including a second deflecting member positioned directly in front of said folding pocket, said second deflector being movable, after the material being folded has entered the folding pocket from a resting position, which does not affect the material being folded and the enclosures, to a second folding station, while the material being folded is deflected at the same time to form a fold; and electronic control means for controlling said first and second enclosure feed means and said first and second deflecting members in order to combine one of the first and second enclosures in a plurality of positions with the sheet and to fold the sheet in a plurality of different forms with said one of the first and second enclosures.

2. A Folding machine in accordance with claim 1, wherein said knife-like deflecting member is formed of a bent guide plate and has a rear web guide directed toward the intake device, when said first deflecting means is in a deflected position said rear web guide extends at an angle with a feed web.

3. A Folding machine in accordance with claim 1, wherein each said enclosure feed mechanism includes one feeding attachment with a decollating device and a waiting station with a feed roller pair that can be activated by said electronic control device.

4. A Folding machine in accordance with claim 1, wherein electronic control device comprises a microprocessor, and said feed measuring device has a pulse generator synchronized with the feed motion of the material to be folded, and a presettable coincidence circuit.

5. A Folding machine in accordance with claim 3, wherein said feed roller pair can be coupled with a drive synchronized with the feed motion of the material being folded by a clutch that can be actuated with an electromagnet.

6. A Folding machine in accordance with claim 3, wherein said feed roller pair has a feed speed that is greater than the speed at which the material being folded is fed.

7. A sheet folding machine with an enclosure feed, the machine comprising:

first folding means for folding the sheet between two rollers;

second folding means for folding the sheet between two rollers after it has been folded by said first folding means;

sheet feed means for feeding the sheet substantially tangentially across two rollers of said first folding means;

first deflecting means for deflecting the sheet into an area between said two rollers of said first folding means;

a first enclosure feed means for feeding a first enclosure toward said first folding means, said first enclosure feed means being positioned downstream of said sheet feed means;

second enclosure feed means for feeding a second enclosure toward said first folding means, said second enclosure feed means being positioned upstream of said sheet feed means;

pocket means for receiving the sheet after the sheet has passed through said first folding means;

second deflecting means for deflecting the sheet into an area between said two rows of said second folding means; and electronic control means for controlling said first and second enclosure feed means, and said first and second deflecting means in order to combine one of the first and second enclosures in a plurality of positions with the sheet, and to fold the sheet in a plurality of different forms with said one of the first and second enclosures.

* * * * *